US005830009A

United States Patent [19]

Tettinger

[11] Patent Number: 5,830,009

[45] Date of Patent: Nov. 3, 1998

[54] DEVICE FOR CONNECTING A COAXIAL PLUG TO A COAXIAL CABLE

[75] Inventor: Mathias Tettinger, Unterschleissheim, Germany

[73] Assignee: Rosenberger Hochfrequenztechnik GmbH & Co., Tittmoning, Germany

[21] Appl. No.: 713,068

[22] Filed: Sep. 12, 1996

[30] Foreign Application Priority Data

Sep. 12, 1995 [DE] Germany ..... 195 33 721.2

[51] Int. Cl.[6] ..... H01R 9/05

[52] U.S. Cl. ..... 439/578; 439/584; 439/805

[58] Field of Search ..... 439/578, 583, 439/584, 429, 805

[56] References Cited

U.S. PATENT DOCUMENTS

| | | | |
|---|---|---|---|
| 3,291,895 | 12/1966 | Van Dyke . | |
| 3,498,647 | 3/1970 | Schroder . | |
| 3,501,737 | 3/1970 | Harris et al. . | |
| 4,046,451 | 9/1977 | Juds et al. | 439/583 |
| 4,973,265 | 11/1990 | Heeren . | |
| 5,167,533 | 12/1992 | Rauwolf . | |
| 5,284,449 | 2/1994 | Vacarro . | |
| 5,334,051 | 8/1994 | Devine et al. . | |
| 5,435,745 | 7/1995 | Booth | 439/583 |
| 5,518,420 | 5/1996 | Pitschi | 439/578 |

FOREIGN PATENT DOCUMENTS

A-517034 12/1992 European Pat. Off. .

*Primary Examiner*—Neil Abrams
*Assistant Examiner*—Brian J. Biggi
*Attorney, Agent, or Firm*—Lowe Hauptman Gopstein Gilman & Berner

[57] ABSTRACT

The invention concerns a connecting device to connect a coaxial plug (1) to a coaxial cable (2), comprising a contact bush (7, 107) which on one hand can be screwed by means of a thread (8, 108) onto the cable conducting corrugated tube (4, 5) respectively, and on the other hand is connectable to the plug thread (6) of the coaxial plug (1), the device being further designed in such manner that the contact bush (7, 107) constitutes, at its plug-side end, tongs (10, 110) with resilient clamping segments (11, 111), the tongs comprising a conical compressive surface (15, 115) and compressive cone (16, 116) located at the plug-side and cooperating with the compressive surface (15, 115) allowing to press the tongs radially against the cable conducting corrugated tube (4, 5), respectively.

18 Claims, 2 Drawing Sheets

DEVICE FOR CONNECTING A COAXIAL PLUG TO A COAXIAL CABLE

Figure 1:
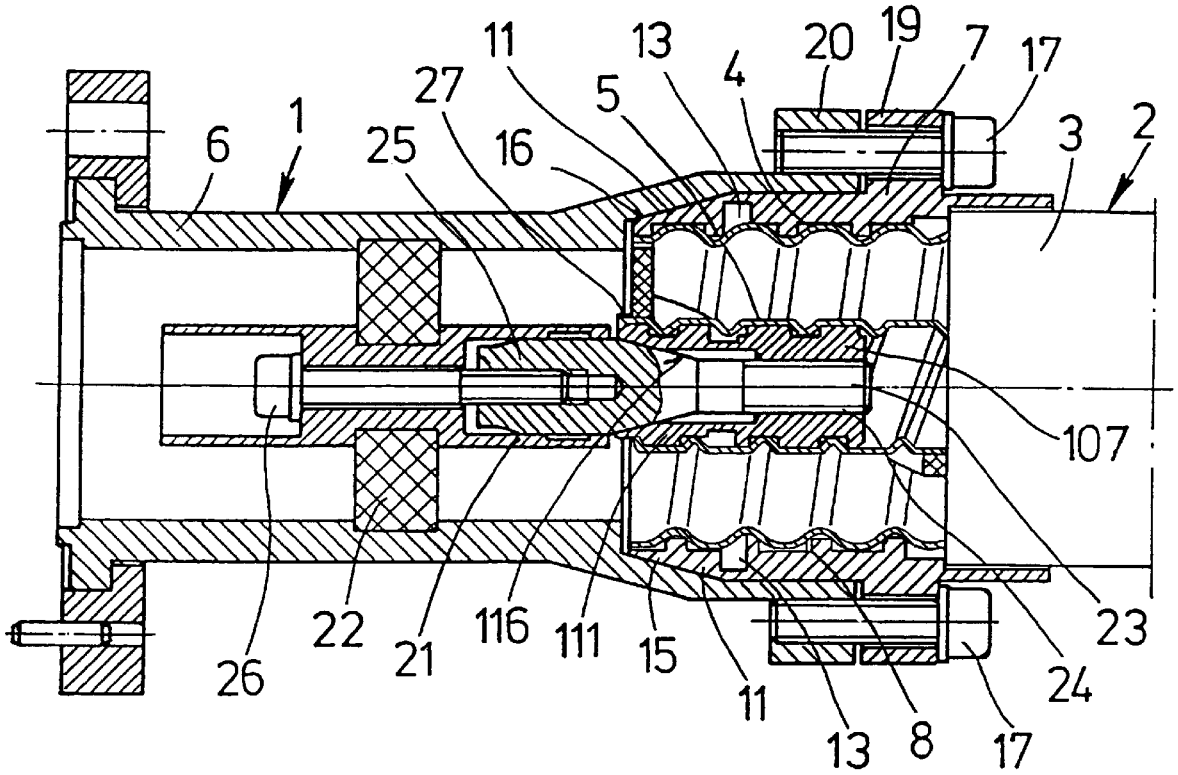

The invention concerns a device for connecting a coaxial plug to a coaxial cable as defined in the preamble of claim 1.

Such coaxial cables with a corrugated outer conductor and where called for also a corrugated inside conductor including the correspondingly connected plug are used in various sizes and power ratings to transmit high-frequency power, for instance in mobile radio networks, radio and TV facilities, directional radio systems, radar and satellite ground stations etc. worldwide in large numbers.

Exceedingly high quality of assembly is required for the connection between the conductor parts of the coaxial plug and the corrugated outer conductor or inner conductor of the coaxial cable in order to meet the high electrical and mechanical requirements especially of good contacts and highest possible loss-free transmission.

As regards the heretofore known connection devices of this species, the connection for instance of the outer conductor of the corrugated sheath cable in to the corresponding outer conductor of the coaxial plug is implemented by screwing a contacting bush, in the form of a retaining bush, onto the outer cable conductor until said bush hits the plastic insulator of the cable. Then the projecting outer conductor tube of the corrugated sheath cable is bent outward by 90° C. manually or using complex assembly mechanisms to make it rest against the end surface of the screwed-on contact bush.

The corrugated inner cable conducting tube is connected in the same manner to the inner plug conductor. For that purpose an inner-conductor contact piece is screwed into the inner cable conductor and thereupon a correspondingly projecting end of the inner cable conductor is flanged inward by about 45° on a conical part of this inner-conductor contact piece.

In both cases the flanging of the corrugated cable conductor tubes entails on one hand mechanically affixing the contact bush or inner-conductor contact piece to the particular cable conductor and on the other hand implementing the flanging simultaneously forming the electrical contact surface. Consequently the electrical connection quality between the coaxial cable and the coaxial plug critically depends on the quality of flanging.

Depending on size, installing such cable fittings will require labor time from 20 to 120 minutes. Thus the cited connection can be made only at high demand in time and hence at high cost.

Lastly phase matching frequently requires that the assembled connection between the coaxial plug and the coaxial cable be disassembled again in order to shorten the cable by a length for instance of 2–5 mm. This procedure also is highly time-consuming because the flanging must be bent back into its initial position to allow screwing off the contact bush or the inner conductor contact-piece and re-cutting the particular cable conductor. After that the particular cable conductor must be flanged again. As a result substantial time will have been expended.

Based on this state of the art, the object of the invention is to so design the connecting device of the said species that it may be assembled or disassembled rapidly without resort to specialized tools and that while offering simple component design it will very well meet both electrical and mechanical requirements.

The features used in solving this problem are stated in claim 1. Advantageous embodiments are described in the further claims.

The connecting device of the invention comprises a contact bush such that at its plug side it forms clamping tongs with resilient clamping segments; these clamping tongs evince a conical compressive surface and can be radially pressed, by means of a cooperating compressive cone present at the plug side, against the corrugated cable conducting tube.

In this manner the contact bush is affixed most effectively to the particular corrugated cable conducting tube; at the same time, the radially resilient clamping segments ensure defined contact at the first corrugation turn, i.e. thread of the corrugated cable conductor tube is assured. This contact at the mentioned site is critical, and it is achieved in the invention in that the thread of the contact bush illustratively in the form of a contoured thread matched to the corrugated cable conductor tube is rotated free by 360° after the first thread. As a result the clamping segments of the clamping tongs are able to act as springs and, on account of their being clamped together radially by the plug-side compressive cone are compressed over a circumferential angle of 360° and thereby achieves defined contact.

Preferably the contact bush of the invention is made of a silvered brass material offering good high-frequency conductivity.

The threaded part, ie the contoured thread of the contact bush preferably runs over its entire length including the clamping tongs. In this respect and as already mentioned, the clamping segments are designed in such manner that in their radially compressed position implemented by the plug-side compressive cone they make contact with the first threaded turn of the corrugated cable conductor tube.

In order to make possible and/or to enhance this radial clamping of the clamping segments, the invention provides that the clamping tongs be offset by an annular channel from the remaining part of the contact bush, said channel being of a depth larger than the threaded troughs of the contoured thread. However in lieu of an annular channel it is also possible to secure the resiliency of the individual clamping segments in another suitable manner, for instance by means of an appropriately lesser wall thickness of the clamping tongs.

When the connecting device of the invention used to connect the outer conductor of the coaxial plug to the corrugated outer conductor cable tube is put in service, the configuration is such that contoured thread of the contact bush forms an inside thread and that the conical compressive surface of the tongs is located at the outside of these tongs.

In this case an advantageous design of the invention provides that the plug-side compressive cone be present at the inner circumferential surface of the plug housing forming the outer conductor.

On the other hand if the connecting device of the invention is meant to connect the inner conductor of the coaxial plug to the corrugated cable inner conductor tube, then the contoured thread of the contact bush shall be a male thread and the conical compressive surface of the tongs will be present at the inner periphery of these tongs.

In the latter case the invention provides that the plug-side compressive cone be present at the outside of a contact bolt of which one end can be screwed by a male thread into the contact bush for the purpose of compressing the clamping segments against the cable inner conductor tube and of which the other end evinces a cylindrical segment to be resiliently coupled to the inner conductor of the coaxial plug.

Lastly the invention relates to the inner-conductor contact bush comprising at its plug-side end a stop in the form of an annular collar projecting outward from the free end of the clamping tongs. Thereby a defined position of the inner-conductor contact bush is secured relative to the cable inner conductor without requiring special work on said inner conductor.

Accordingly the invention on the whole allows cutting the previously known assembly time and cost by up to and more than 50%. Another substantial advantage is that special tools are not required to implement the connection. Hence assembly can be carried out in problem-free manner on the site also. Any phase matching entailing shortening of the cable also can be carried out easily in a short time.

The invention offers exceedingly advantageous simplification of the designs of plug elements. As a result substantial savings are achieved compared to the known connecting devices.

The invention is elucidated below in relation to the drawings.

Figure 2:
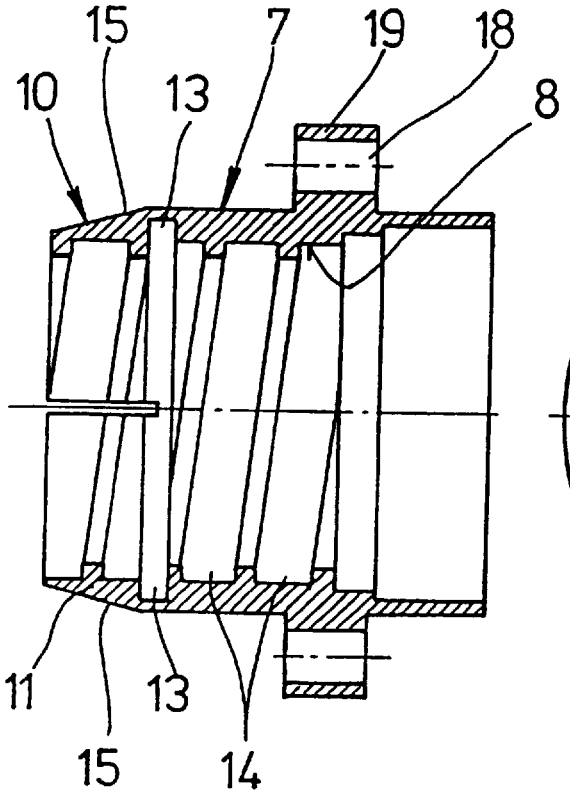
Figure 3:
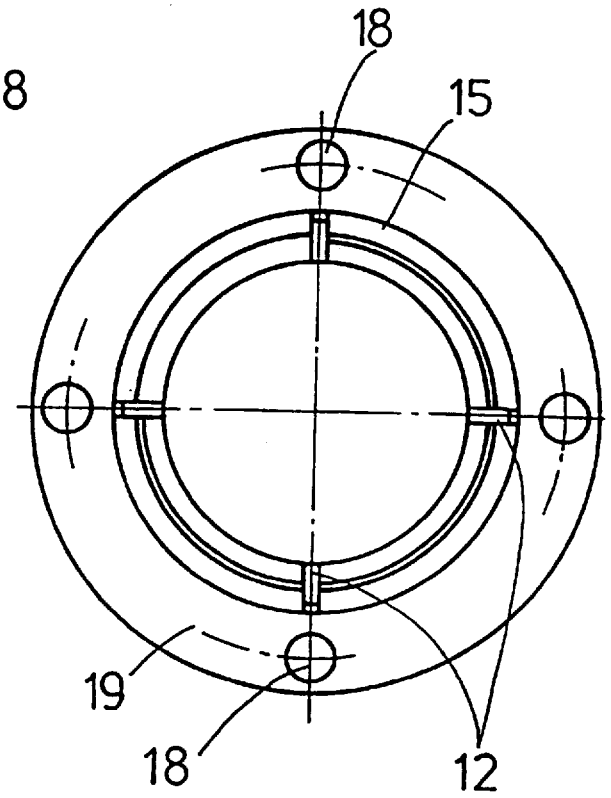
Figure 4:
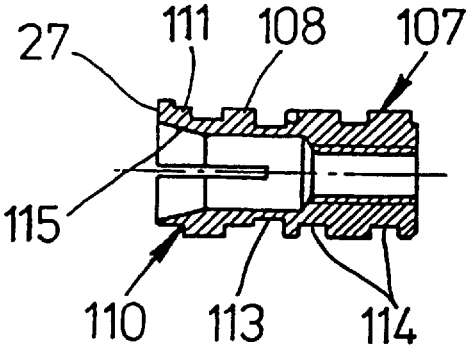
Figure 5:
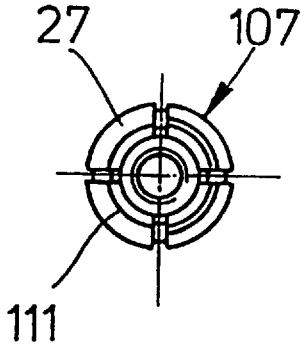

FIG. 1 is schematic section of the connecting device of the invention when assembled, FIG. 2 shows a section of the contact bush for the outer cable conductor, FIG. 3 is a front view FIG. 4 is a section of the contact bush for the inner cable conductor, and FIG. 5 is a front view corresponding to said contact bush.

As shown in the drawings and in particular in FIG. 1, the shown connecting device is used to connect a coaxial plug 1 to a coaxial cable 2. In the embodiment shown, this coaxial cable 2 is in the form of a flexible corrugated copper sheath cable and in this design comprises an outer cable conductor 4 in the form of a corrugated copper tube enclosed by a plastic cover 3 and of an inner cable conductor 5 centrally held by an insulator relative to said outer conductor, said inner conductor 5 also being in the form of a corrugated tube.

A contact bush 7 is provided to connect the corrugated outer cable conducting tube 4 to the corresponding outer conductor part of the coaxial plug 1, that is to the plug housing 6, said bush 7 evincing the configuration shown in FIGS. 1, 2 and 3. This contact bush 7 comprises a an inner thread 8 designed as a contour thread matching the thread of the outer cable conductor 4. Thereby said thread 8 is easily screwed onto the outer cable conductor 4 in such a way that the free end of the outer cable conductor 4 is flush with the plug-side of the contact bush 7.

The drawing further shows that at its plug-side end the contact bush 7 comprises clamping tongs 10 with resilient clamping segments 11, said segments in the shown embodiment being formed by the clamping tongs 10 evincing four equally spaced axial slits 12. Obviously an arbitrary number of slits 12 also may be provided.

The drawing shows that the thread 8 of the contact bush 7 runs over the entire length of this bush including the clamping tongs 10. To assure the spring and resiliency and clamping functions of the clamping tongs 10, the tongs design is such that they are offset by an annular channel 13 relative to the remaining part of the contact bush 7, said channel evincing a greater depth than the thread troughs 14 of the contoured thread 8 (FIG. 2).

The clamping tongs 10, i.e. their resilient clamping segments 11 evince an outer conical compressive surface 15. Said compressive surface 15 cooperates with a matching compressive cone 16 present at the inner circumference of the plug housing 6 forming the outer conductor part in such manner that the resilient clamping segments 11 of the clamping tongs 10 when in the radially compressed position implemented by the plug-side compressive cone 16 will contact the full first thread turn of the outer cable conductor 4, that is over an circumferential angle of 360°.

The radially clamped position of the clamping segments 11 also is implemented when the coaxial plug 1 is affixed to the coaxial cable 2. This mode is obtained conventionally in the shown embodiment using screw connections, the screws 17 passing through matching boreholes 18 in an annular flange 19 of the outer-conductor contact bush 7 and being screwed into threaded boreholes of an annular flange 20 present on the coaxial plug 1.

The described connecting device furthermore implements connection—construed in the same sense—of the corrugated cable conductor inner tube 5 to the pertinent inner conductor part of the coaxial plug 1. This plug inner conductor part is a resilient sleeve 21 in the embodiment shown and is kept centered in the coaxial plug 1 by an insulating spacer 22 affixed to the plug housing 6.

The inner-conductor contact-bush 107 corresponding to the outer-conductor contact bush 7 therefore comprises a thread 108 in the form of a contoured male thread. Also the conical compressive surface 115 of the clamping tongs 110 located at the inside circumference of the tongs, ie at their clamping segments 111, is offset by an outer annular channel 113 from the remaining part of the inner-conductor contact-bush 107. In this case too the outer radial annular channel 113 evinces a greater depth than the thread depths 114 of the contoured thread 108 in order to ensure resiliency of the clamping segments 111.

The compressive cone 116 cooperating with the inner conical compressive surface 115 of the inner-conductor contact-bush 107 is present at the outside of a contact bolt 23 as shown in FIG. 1. This contact bolt can be screwed by means of an outer thread part 110 into the inner-conductor contact bush 107 to radially compress the resilient clamping segments 111 of the clamping tongs 110 against the corrugated cable inner-conductor 5. Also this contact bolt 23 comprises a cylindrical section 25 which is insertable for the purpose of coupling to the inner-conductor part of the coaxial plug into the matching resilient bush 21 wherein it can be fastened in place by an inner-conductor central screw 26.

The contact bush 107 comprises a stop 27 at its plug-side end for the purpose of screwing the inner-conductor contact-bush 107 a specified length into the corrugated cable inner conductor 5. Said stop assumes the shape of an outwardly projecting annular collar and is present at the free end of the tongs 110.

Explicit reference is made thereby to the claims and the drawings regarding features of the invention not individually described above.

I claim:

1. A connecting device for electrically and mechanically coupling a coaxial plug having a plughead with a coaxial cable having a longitudinally extending conducting corrugated tube extending beyond an end face of a casing of the cable, the connecting device comprising a contact bush including a first end adapted to be connected to the corrugated tube of the cable and a second end adapted to be connected to the plughead, a stop adjacent the first end for receiving the end face, the second end including clamping tongs having resilient clamping segments for engaging the plughead, the clamping segments including a compressive cone having a compressive frusto-conical surface responsive to a force applied by the plug, the bush including undulations extending longitudinally from the second end substantially to the stop, the indulations mating with the corrugations of the corrugated tube from the second end substantially to the stop, the compressive frusto-conical surface responding to the force applied by the plug for applying a radial force through the undulations against the conducting corrugated tube of the coaxial cable, the bush including a circular groove intersecting the undulations, the groove being positioned, arranged and having a geometry to provide resilient, spring and clamping characteristics for the clamping tongs.

2. The apparatus according to claim 1 wherein the undulations are configured as threads and the groove is an annular channel having a depth greater than the deepest of the threads.

3. The apparatus according to claim 2 wherein the channel offsets the tongs from the remainder of the bush.

4. The apparatus according to claim 1 wherein the groove offsets the tongs from the remainder of the bush.

5. The connecting device of claim 4 wherein the coaxial plug has an exterior conducting part and the cable conducting corrugated tube has an exterior surface, the conical compressive surface of the tongs being at an outer surface of said tongs adapted to be engaged by the plug exterior conducting part for establishing electrical and mechanical coupling of said exterior part and said exterior surfaces to each other.

6. The connecting device of claim 5 wherein the coaxial plug has a housing forming an outer conductor part of the plug, the housing including an inner frusto-conical surface, the compressive cone adapted to be engaged and urged inwardly by the frusto-conical surface of the coaxial plug.

7. The connection device of claim 4 wherein the coaxial plug includes a longitudinally extending interior conductor part and the cable includes a corrugated longitudinally extending interior conducting tube, the bush including a further conical compressive surface of the tongs located on the inside of said tongs.

8. The connecting device of claim 7 wherein the compressive cone is positioned to be responsive to insertion of the plug in the bush, the compressive cone being located outside of a contact bolt which can be screwed by an outer thread into the contact bush for pressing a clamping segment of the bush against the cable corrugated inner conducting tube, the contact bolt comprising a cylindrical section adapted to be coupled to the inner conductor part of the coaxial plug.

9. The connecting device of claim 7 wherein an interior conductor of the contact bush comprises at the first end a stop having an outwardly projecting annular collar.

10. A connector for connecting a coaxial plug having interior and exterior longitudinally extending coaxial conductors to a coaxial cable having interior and exterior coaxial conductors, the plug including at least one camming surface, at least one of the coaxial cable conductors being a corrugated cable extending beyond a tubular end face of the cable, the connector comprising:

a metal bush having spaced mutually insulated coaxial interior and exterior cylindrical segments, the interior and exterior segments being arranged to be electrically and mechanically connected to the interior and exterior conductors of the plug and cable so that (a) the plug fits into a second end of the segments, (b) the plug interior conductor is adapted to engage the bush interior segment, (c) the plug exterior conductor is adapted to engage the bush exterior segment, (d) the cable fits into a first end of the segments, (e) the cable interior conductor is adapted to engage the bush interior segment, and (f) the cable exterior conductor is adapted to engage the bush exterior segment; at least one of the segments including an undulating coaxial cylindrical surface adapted to mate with the corrugated tube of the at least one conductor of the coaxial cable, the undulating surface extending longitudinally from the second end substantially to the stop, said at least one segment having a surface adapted to be engaged by the at least one camming surface and responding to a force applied by the camming surface for radially urging the undulating coaxial surface of the at least one segment into contact with the corrugated tube of the at least one conductor, said at least one undulating coaxial cylindrical surface including a circumferential groove intercepting undulations on the undulating surface, the groove being positioned, arranged and having a geometry to provide spring, resilient and clamping characteristics of the surface for radially urging the undulating coaxial surface of the at least one surface into contact with the corrugated tube of the at least one conductor.

11. The connector device of claim 10 wherein the undulating surface is a threaded surface and the groove is an annular channel extending into the threaded surface to a greater depth than the deepest threads.

12. The connector device of claim 10 wherein the groove offsets the surface for radially urging the undulating coaxial surface of the at least one surface into contact with the corrugated tube of the at least one conductor from the rest of the metal bush.

13. The connector device of claim 12 wherein the at least one coaxial cable conductor is the cable exterior conductor and the camming surface is on an interior surface of the plug exterior coaxial conductor, the bush exterior segment having an exterior surface adapted to mate with the plug interior surface, the bush exterior segment responding to engagement thereof by the plug camming surface to exert an inwardly directed radial force against the corrugated exterior tube of the coaxial cable, wherein the undulating surface is on the interior of the exterior bush segment.

14. The connector device of claim 13 wherein the camming surface includes a frusto-conical portion, and the bush surface mating with the camming surface is frusto-conical so that the camming surface applies longitudinal and radial forces to the bush exterior segment, the annular channel being positioned so it is responsive to the longitudinal and radial forces applied by the camming surface to the exterior segment.

15. The connector device of claim 13 wherein the at least one coaxial cable conductor is the cable interior conductor and the camming surface is on an exterior surface of the plug interior coaxial conductor, the bush interior segment having an interior surface adapted to mate with the plug exterior surface, the bush interior segment responding to engagement thereof by the plug camming surface to exert an outwardly directed radial force against the corrugated interior tube of the coaxial cable.

16. The connector device of claim 15 wherein the camming surface includes a frusto-conical portion, and the bush surface mating with the camming surface is frusto-conical, so that the camming surface applies longitudinal and radial forces to the bush interior segment, the groove being positioned so it is responsive to the longitudinal and radial forces applied by the camming surface to the interior segment.

17. The connector device of claim 12 wherein both of the coaxial conductors are corrugated, first and second of said camming surfaces respectively being on an interior surface of the plug exterior coaxial conductor and an exterior surface of the plug interior coaxial conductor, the bush exterior segment having an exterior surface adapted to mate with the plug interior surface, the bush exterior segment responding to engagement thereof by the plug first camming surface to exert an inwardly directed radial force against the corrugated exterior tube of the coaxial cable; the bush interior segment having an interior surface adapted to mate with the plug exterior surface, the bush interior segment responding to engagement thereof by the plug second camming surface to exert an outwardly directed radial force against the corrugated interior tube of the coaxial cable; the bush exterior segment having a first stop adjacent the first end for a first end face of an exterior tube of the coaxial cable, the bush exterior segment having an interior surface including a first of said at least one undulating surfaces between the second end and substantially to the first stop, a first of said grooves being in the first of said undulating surfaces, the bush exterior segment responding to engagement thereof by the plug second camming surface to exert an outwardly directed radial force against the corrugated exterior tube of the coaxial cable; the bush interior segment having a second stop adjacent the first end for a second end face of an interior tube of the coaxial cable, the bush interior segment having an exterior surface including a second of said at least one undulating surfaces between the second end and substantially to the second stop, a second of said grooves being in the second of said undulating surfaces.

18. A connector device of claim 17 wherein each of the camming surfaces includes a frusto-conical portion, and the bush surfaces mating with the camming surfaces are frusto-conical so that the camming surfaces apply longitudinal and radial forces to the bush interior and exterior segments, the grooves being positioned so they are responsive to the longitudinal and radial forces applied by the camming surfaces to the bush interior and exterior segments and offset the effects of the forces on portions of the bush segments between the grooves and the stops.

* * * * *